US006463603B1

(12) United States Patent
Camfield

(10) Patent No.: US 6,463,603 B1
(45) Date of Patent: Oct. 15, 2002

(54) CONVERTIBLE WALL BED/SEAT

(76) Inventor: Tinka Camfield, 4427 Exchange Ave., Unit 2-j, Naples, FL (US) 34104

( * ) Notice: Subject to any disclaimer, the term of this patent is extended or adjusted under 35 U.S.C. 154(b) by 0 days.

(21) Appl. No.: 09/133,643

(22) Filed: Aug. 13, 1998

(51) Int. Cl.[7] ..... A47C 17/13
(52) U.S. Cl. ..... 5/18.1; 5/21; 5/58
(58) Field of Search ..... 5/18.1, 17, 21, 5/58

(56) References Cited

U.S. PATENT DOCUMENTS

| | | | | |
|---|---|---|---|---|
| 1,761,261 A | | 6/1930 | Gould | |
| 2,484,377 A | | 10/1949 | Eramo et al. | 5/158 |
| 2,720,659 A | | 10/1955 | Brown | 5/2 |
| 2,856,612 A | | 10/1958 | Wheeler | 5/2 |
| 3,357,030 A | * | 12/1967 | George | 5/18.1 |
| 3,423,772 A | | 1/1969 | Mainguy | 5/2 |
| 3,475,769 A | | 11/1969 | Fasanella | 5/2 |
| 3,729,753 A | | 5/1973 | Johnson et al. | 5/2 R |
| 3,900,905 A | | 8/1975 | Johnson et al. | 5/2 R |
| 3,965,498 A | | 6/1976 | Boni | 5/6 |
| 4,204,287 A | * | 5/1980 | Lane et al. | 5/18.1 |
| 4,402,096 A | * | 9/1983 | Atimichuk | 5/17 |
| 4,481,684 A | * | 11/1984 | Hauck | 5/18.1 |
| 5,101,524 A | * | 4/1992 | Brandschain | 5/18.1 |
| 5,794,283 A | * | 8/1998 | Vila et al. | 5/18.1 |

FOREIGN PATENT DOCUMENTS

| | | | |
|---|---|---|---|
| DE | 2940725 | * | 4/1980 |
| GB | 2078501 | * | 1/1982 |

* cited by examiner

*Primary Examiner*—Alexander Grosz
(74) *Attorney, Agent, or Firm*—Hahn Loeser & Parks LLP

(57) ABSTRACT

A convertible bed/seat which includes a first section positioned as a seat, to accomodate the convertible wall bed/seat mattress in its folded seat configuration, a second section which rolls outwardly on locking casters and drawer guides from the first section and a third storage drawer section which rolls outwardly on locking casters and drawer guides from the second section to form a bed configuration for the convertible wall bed/seat mattress in its bed configuration. The first section is covered by a flat surface which is lowered into place on friction-type lid stays. A two-piece hinged cover is utilized to cover the second section and third storage drawer section to form a substantially flat surface on the convertible wall bed/seat when in its bed configuration for its convertible wall bed/seat mattress in its unfolded bed configuration.

7 Claims, 16 Drawing Sheets

CONVERTIBLE WALL BED/SEAT

BACKGROUND AND SUMMARY OF THE INVENTION

The present invention relates generally to a new and novel convertible wall bed/seat. More particularly, the present invention relates to a new and novel convertible wall bed/seat which is capable of being positioned in a bed configuration and in a seat configuration and is readily convertible therebetween.

In many residences, such as one room efficiencies, floor space is at a premium and it is highly desirable to utilize the same space for more than one purpose. For example, it would be advantageous to utilize the same space for a bed, as well as for a seat. Prior art convertible bed/seats of which applicant is aware have experienced limited acceptance due to various drawbacks, such as the bed/seat being unattractive, difficult to convert from one configuration to another and being overly complex, and thus, overly expensive.

Accordingly, an object of the present invention is to provide a convertible bed/seat which is both attractive and functional.

DETAILED DESCRIPTION

Figure 1:
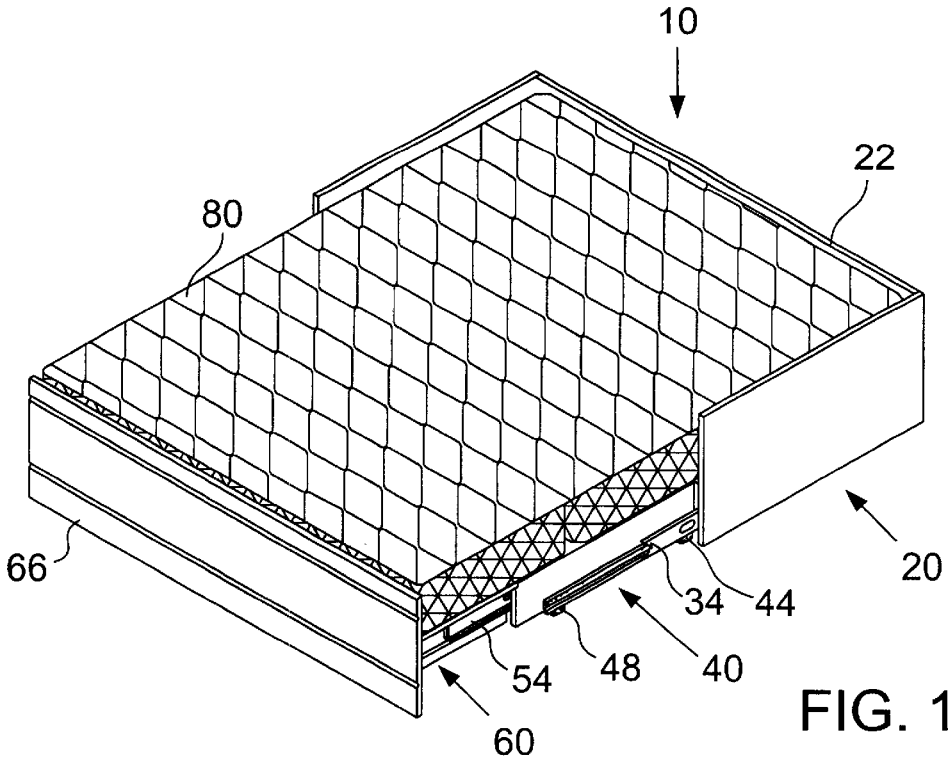
FIG. 1 illustrates a perspective view of the convertible wall bed/seat with mattress.
Figure 2:
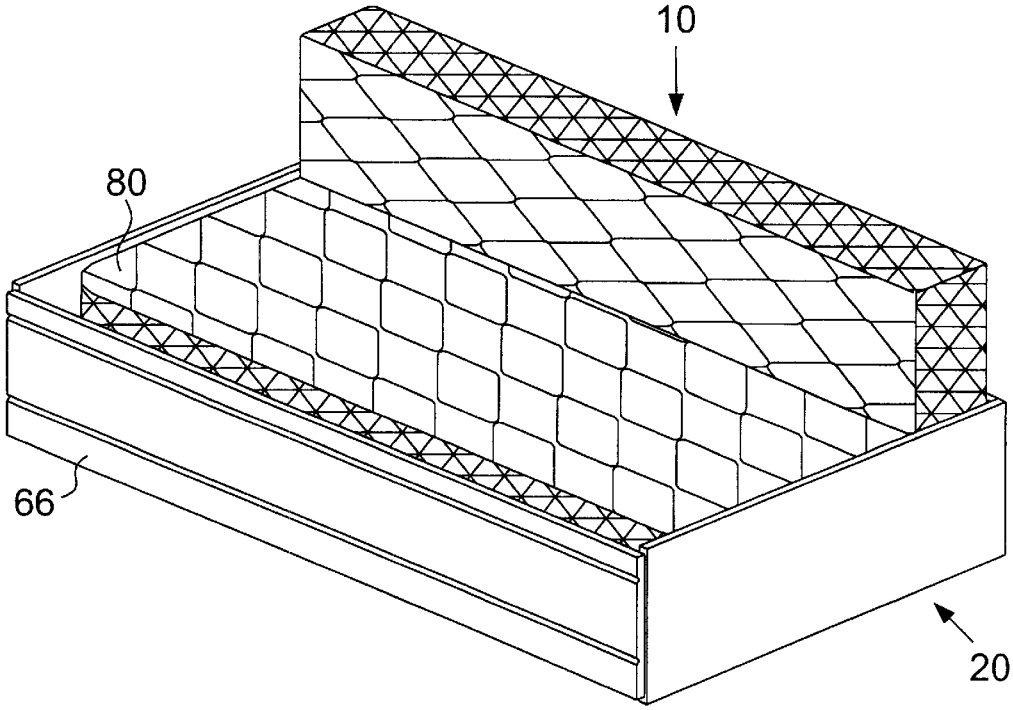
FIG. 2 illustrates a perspective view of the convertible wall bed/seat with mattress.
Figure 3:
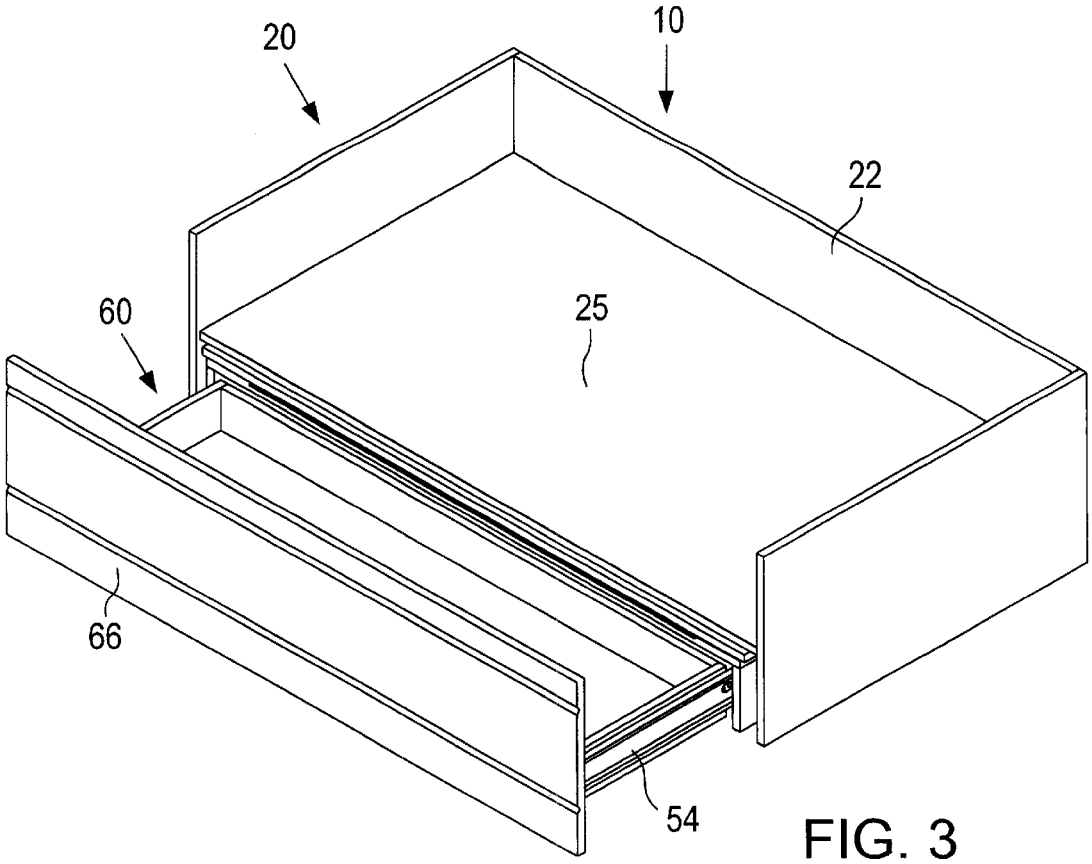
FIG. 3 illustrates a perspective view of a convertible wall bed/seat.
Figure 4:
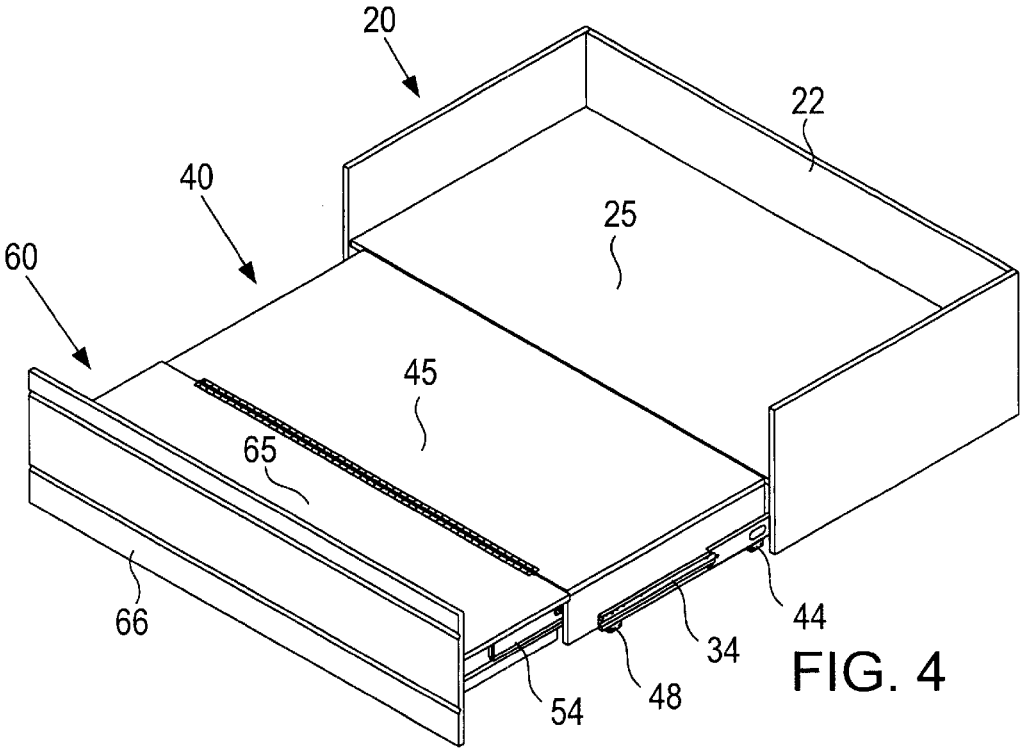
FIG. 4 illustrates a perspective view of the convertible wall bed/seat.
Figure 5:
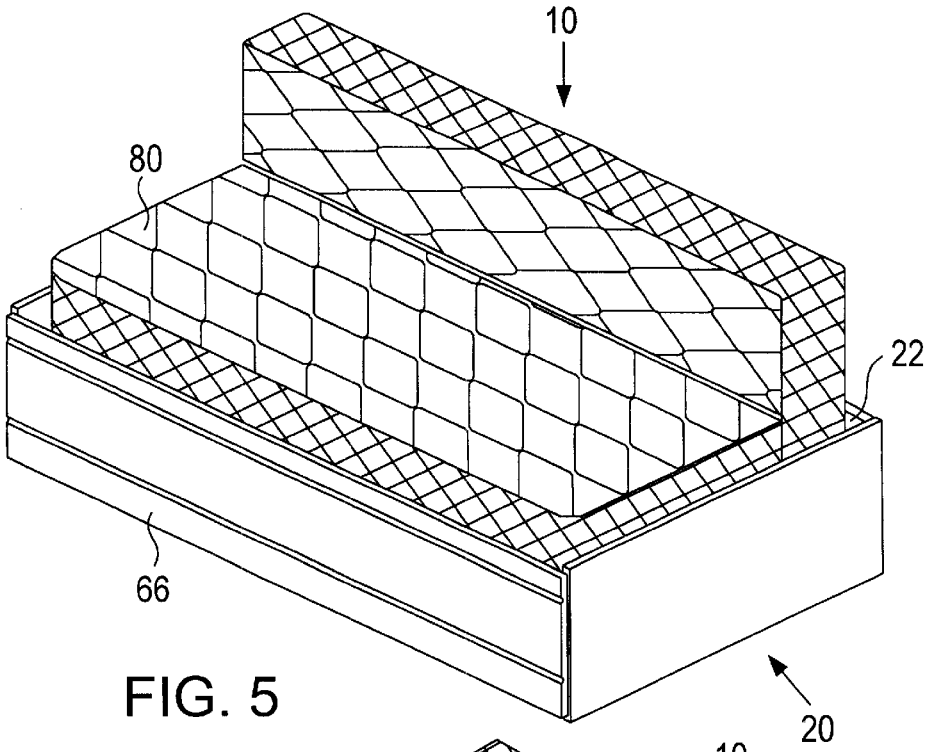
FIG. 5 illustrates a perspective view of the convertible wall bed/seat with mattress.
Figure 6:
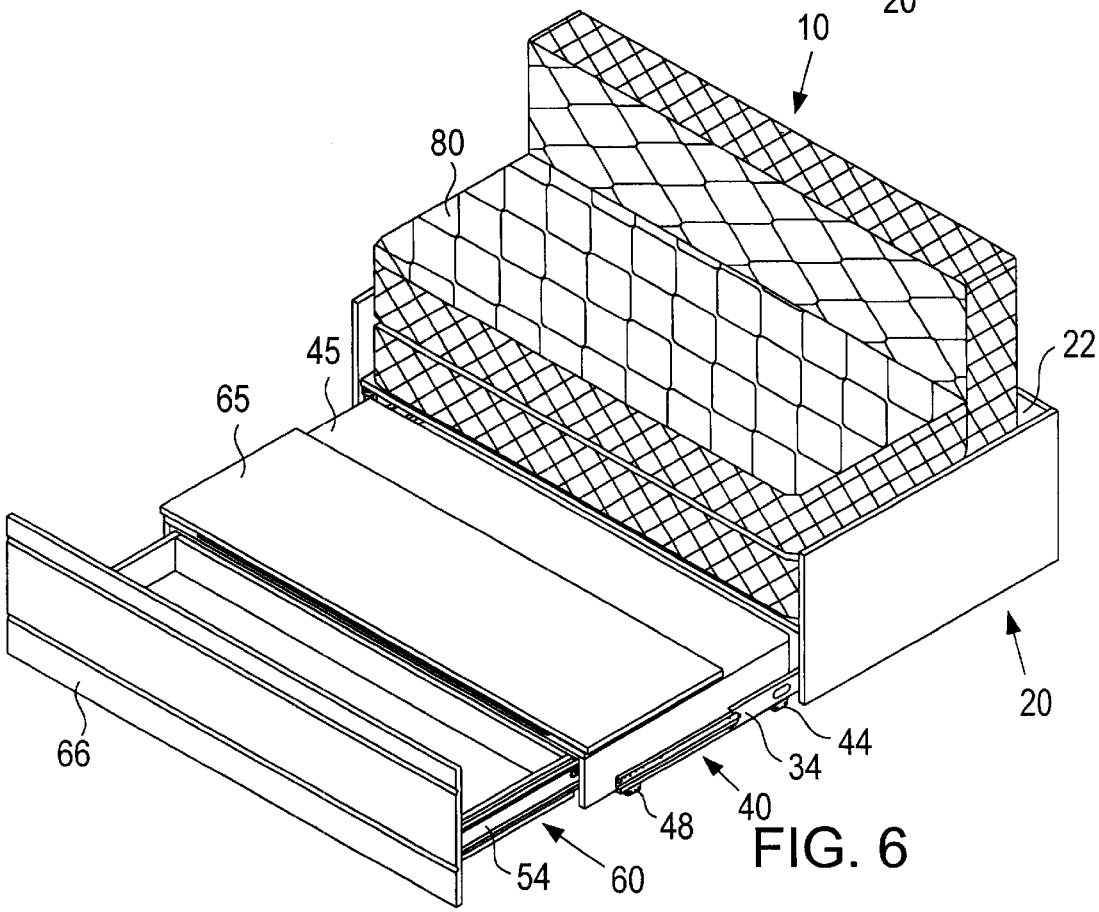
FIG. 6 illustrates a perspective view of the convertible wall bed/seat with mattress.
Figure 7:
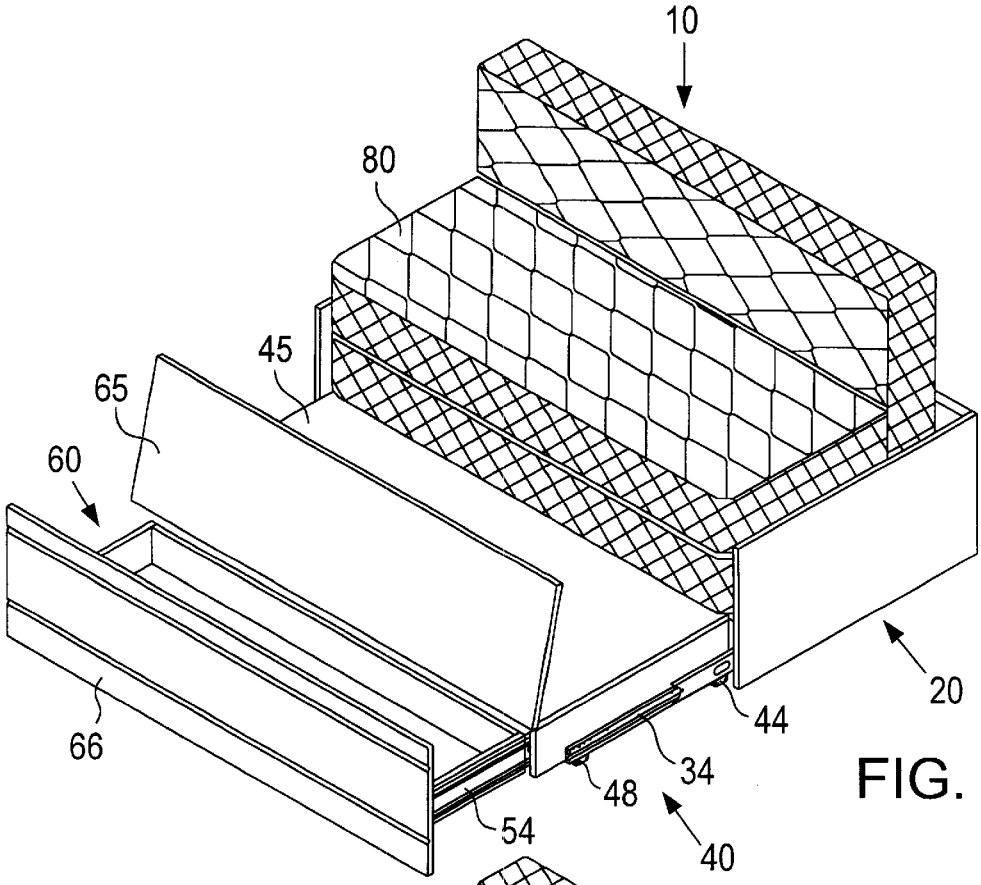
FIG. 7 illustrates a perspective view of the convertible wall bed/seat with mattress.
Figure 8:
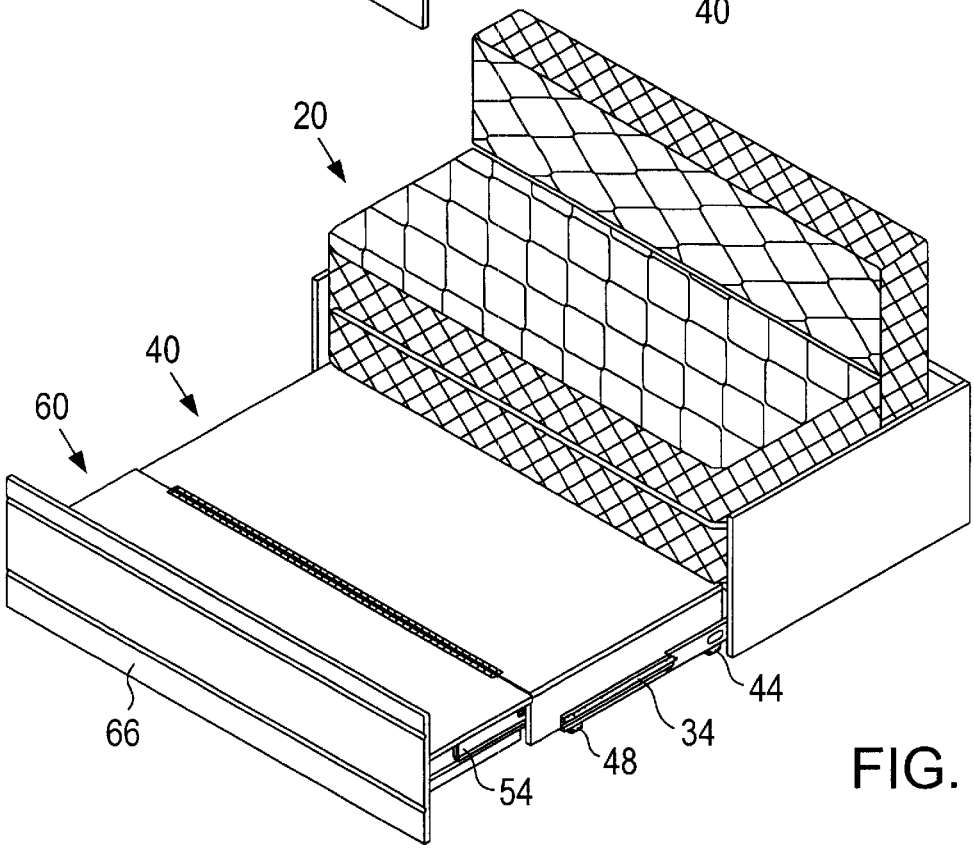
FIG. 8 illustrates a perspective view of the convertible wall bed/seat with mattress.
Figure 9:
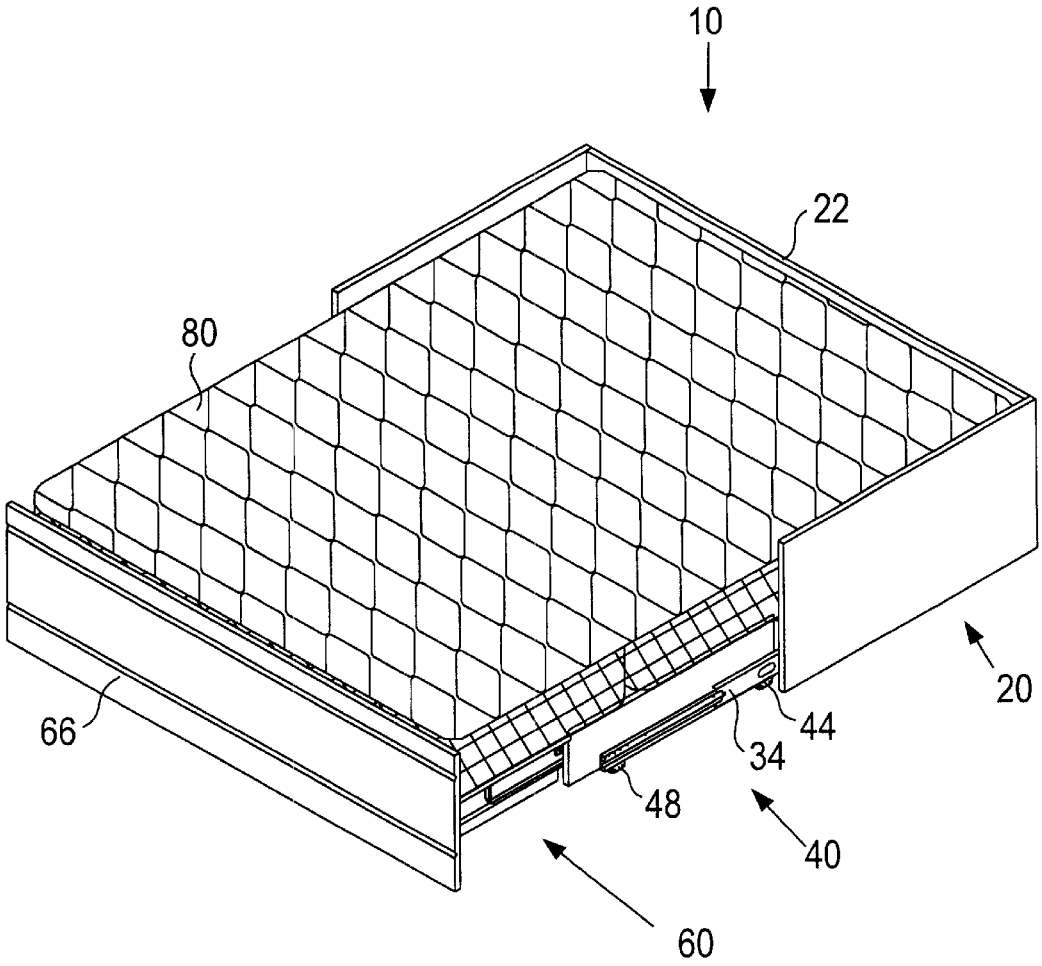
FIG. 9 illustrates a perspective view of the convertible wall bed/seat with mattress.
Figure 10:
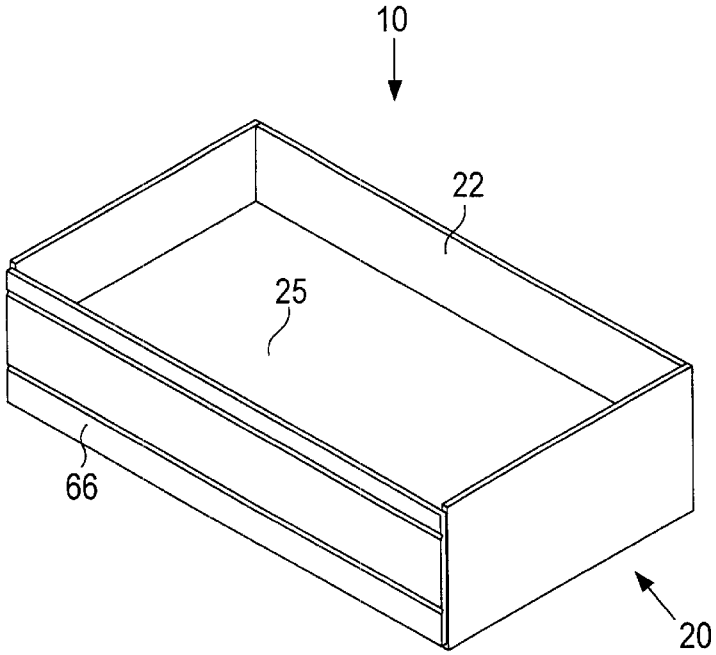
FIG. 10 illustrates a perspective of the convertible wall bed/seat.
Figure 11:
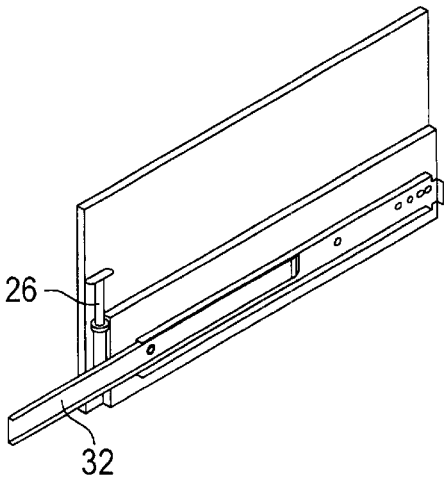
FIG. 11 illustrates a perspective view of a side of the first section.
Figure 12:
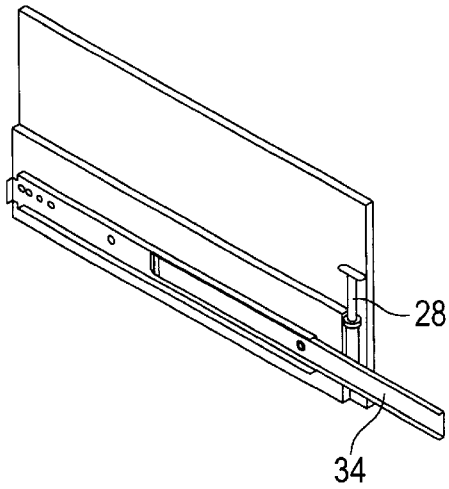
FIG. 12 illustrates a perspective view of a side of the first section.
Figure 13:
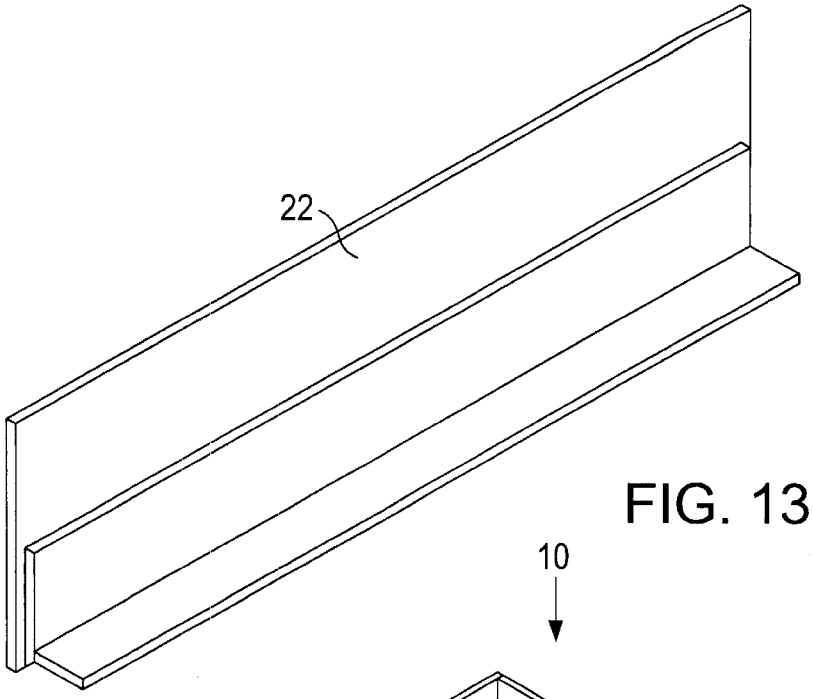
FIG. 13 illustrates a perspective view of the back of the first section.
Figure 14:
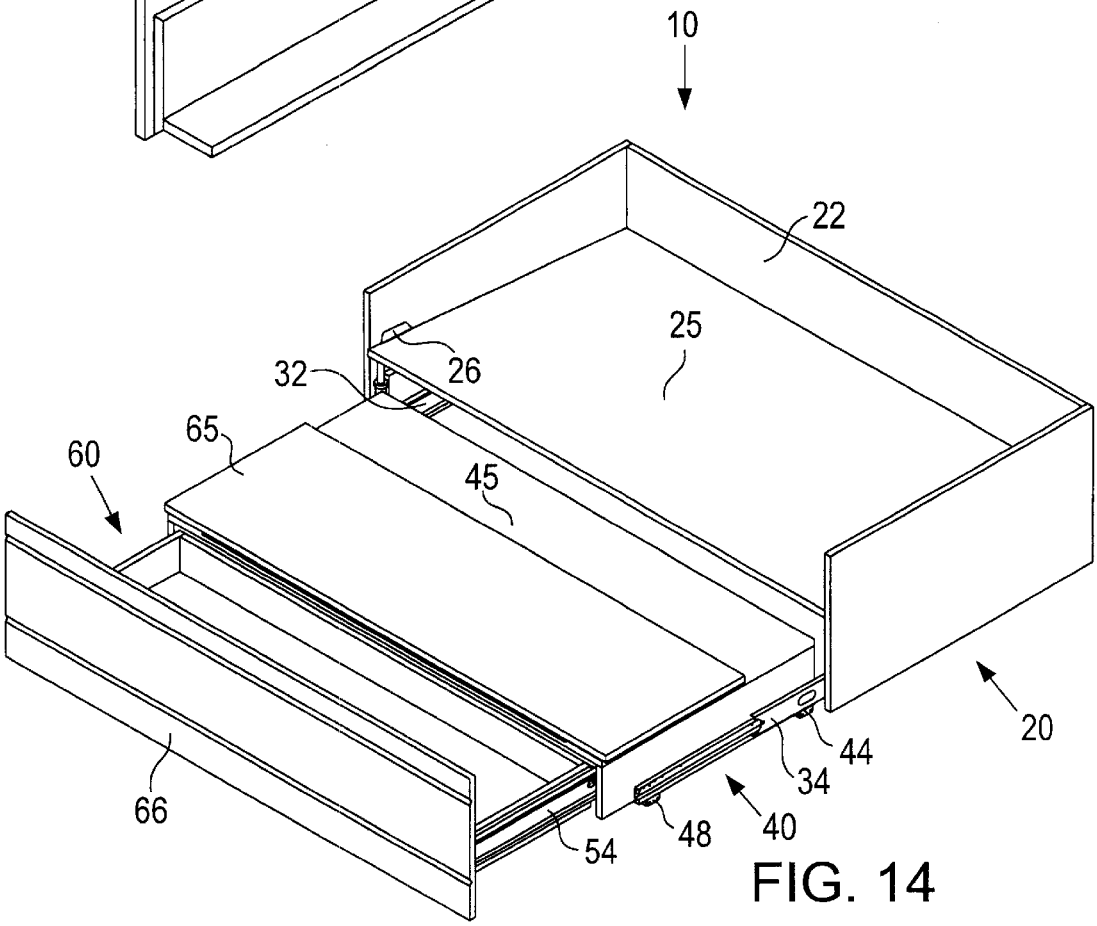
FIG. 14 illustrates a perspective view of the convertible wall bed/seat.
Figure 15:
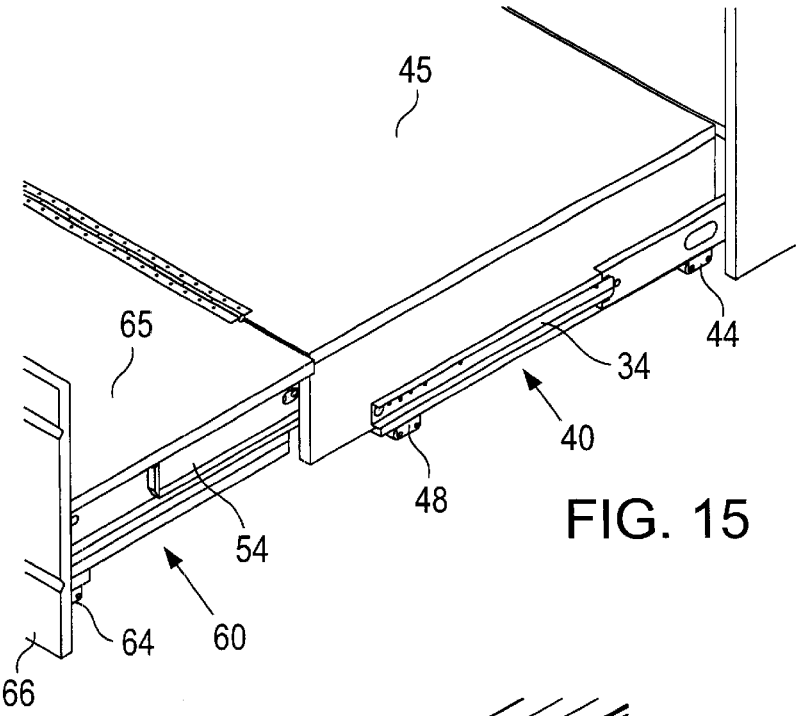
FIG. 15 illustrates a perspective view of the middle section attached to the first section and the third section of the convertible wall bed/seat.
Figure 16:
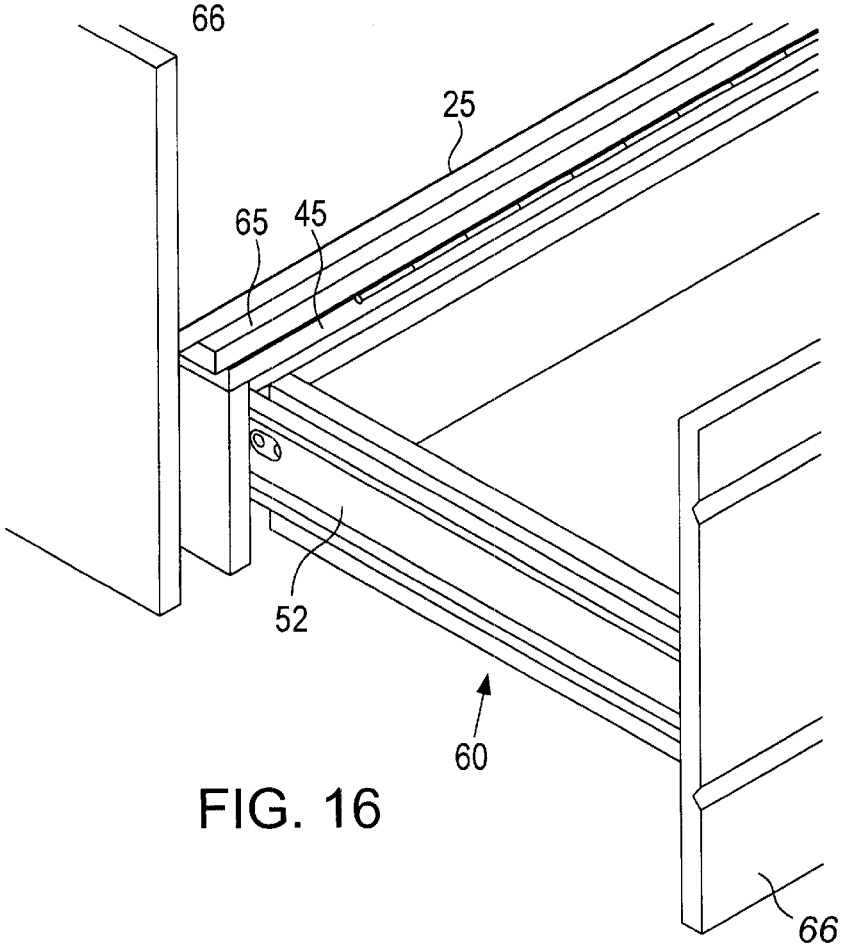
FIG. 16 illustrates a perspective view of the left side of the third section.
Figure 17:
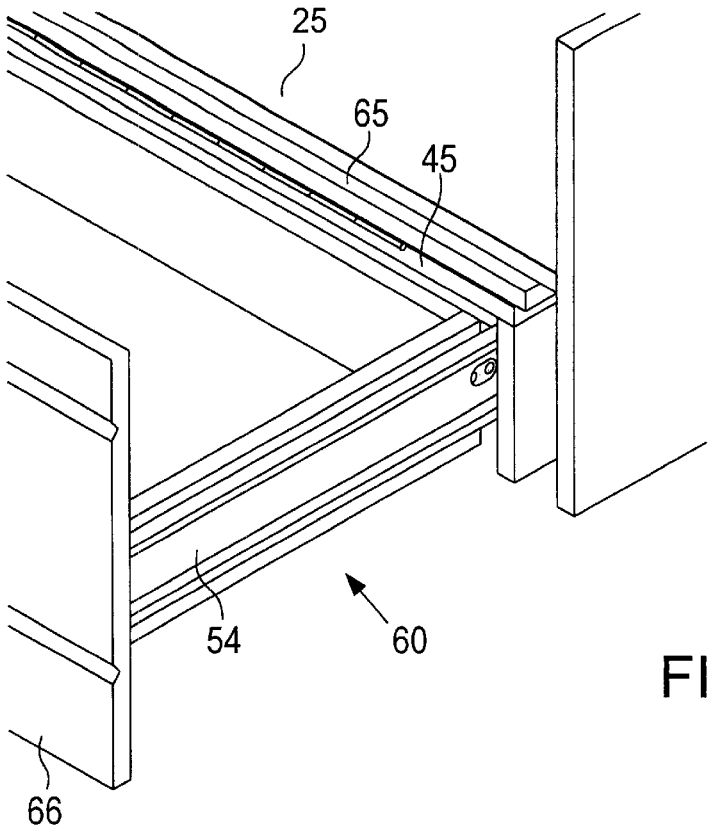
FIG. 17 illustrates a perspective view of the right side of the third section.
Figure 18:
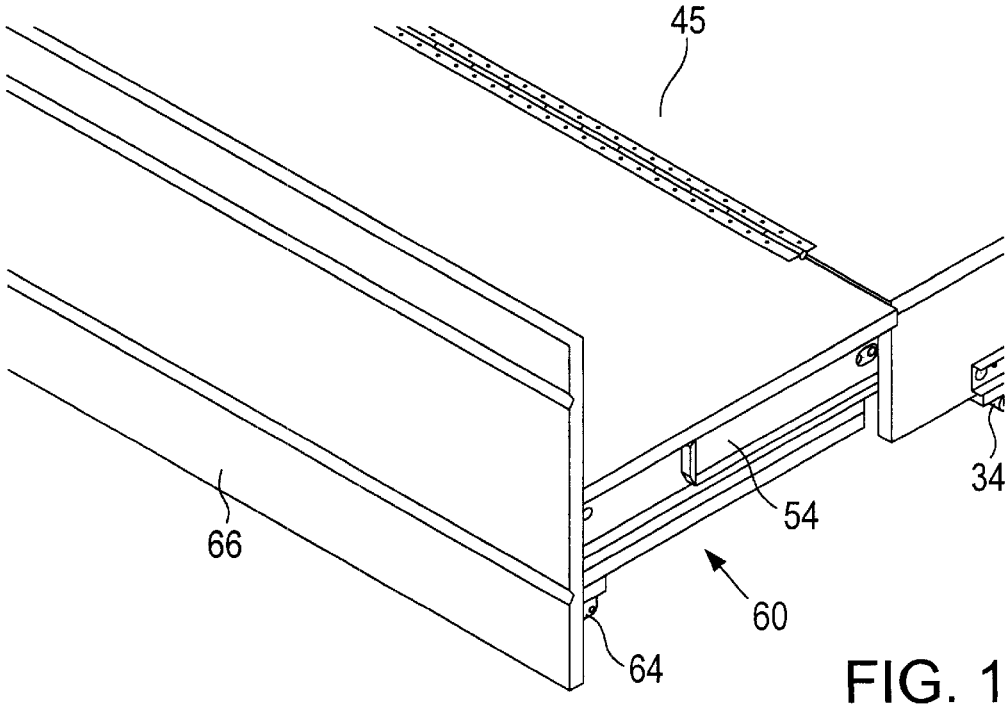
FIG. 18 illustrates a perspective view of the right side of the third section.
Figure 19:
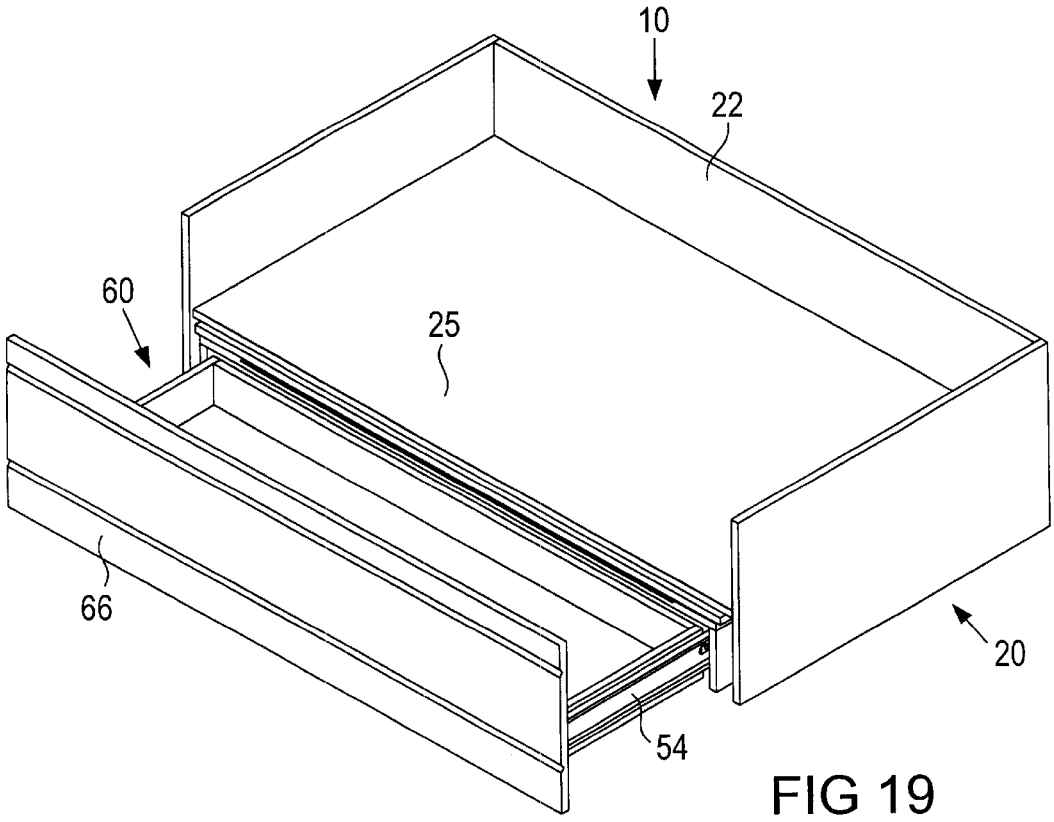
FIG. 19 illustrates a perspective view of the convertible wall bed/seat.
Figure 20:
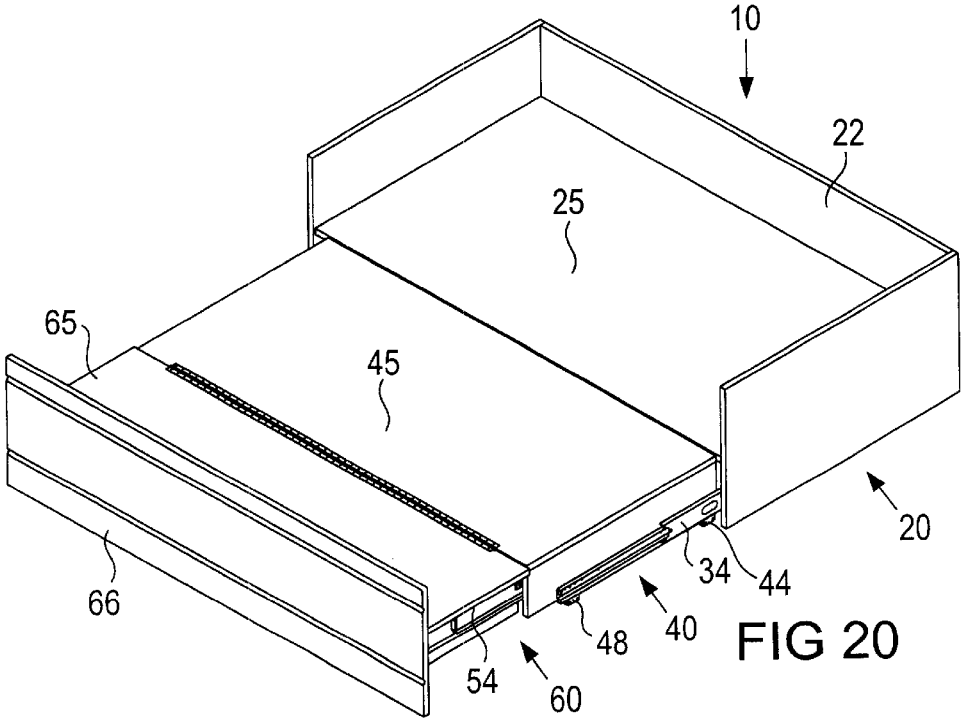
FIG. 20 illustrates a perspective view of the convertible wall bed/seat.
Figure 21:
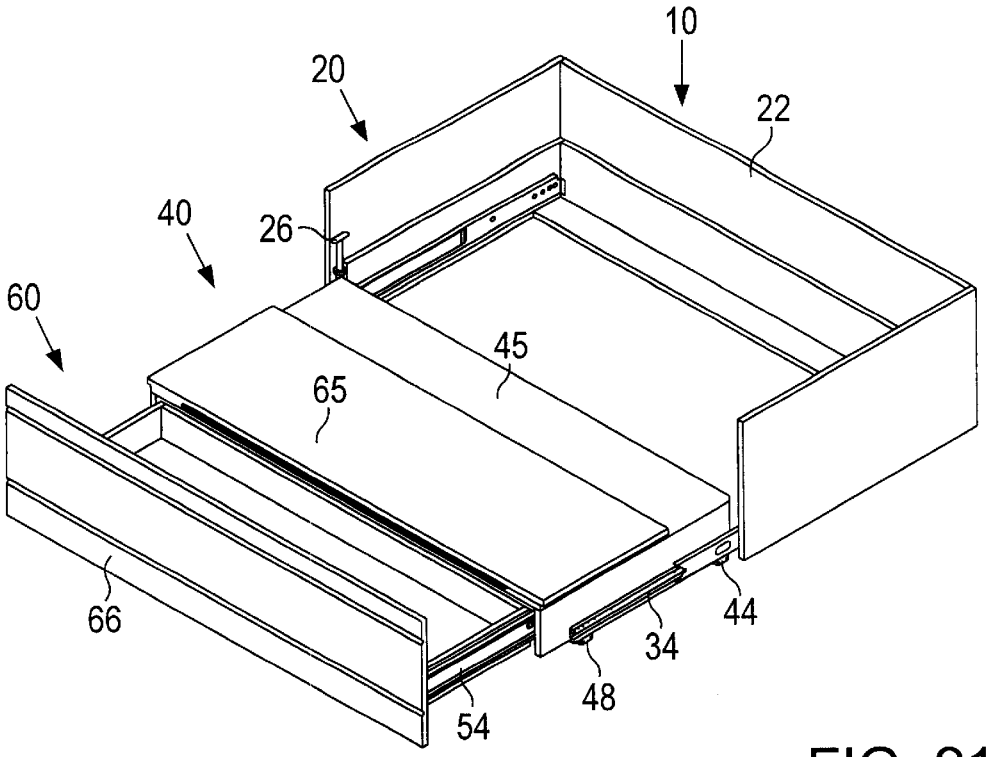
FIG. 21 illustrates a perspective view of the convertible wall bed/seat.
Figure 22:
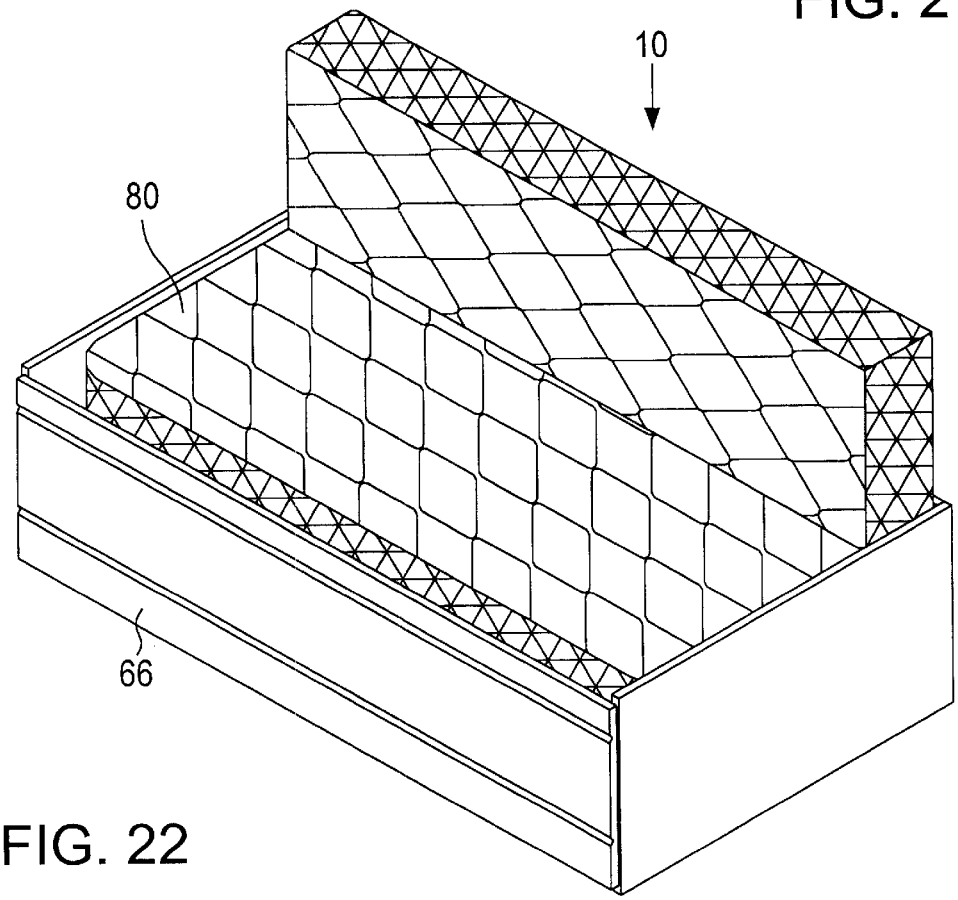
FIG. 22 illustrates a perspective view of the convertible wall bed/seat with mattress.
Figure 23:
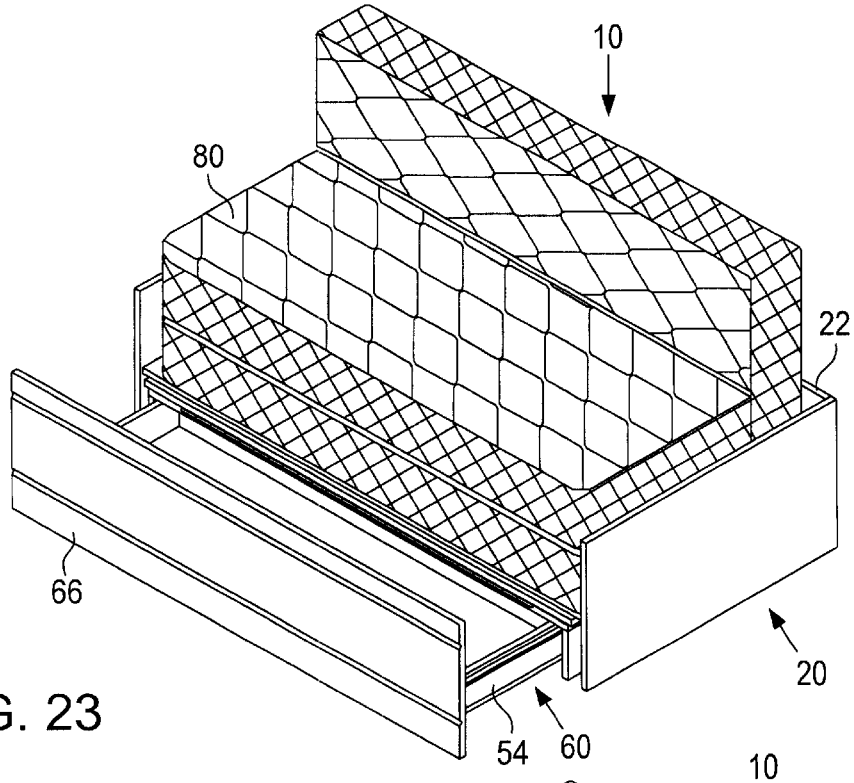
FIG. 23 illustrates a perspective view of the convertible wall bed/seat with mattress.
Figure 24:
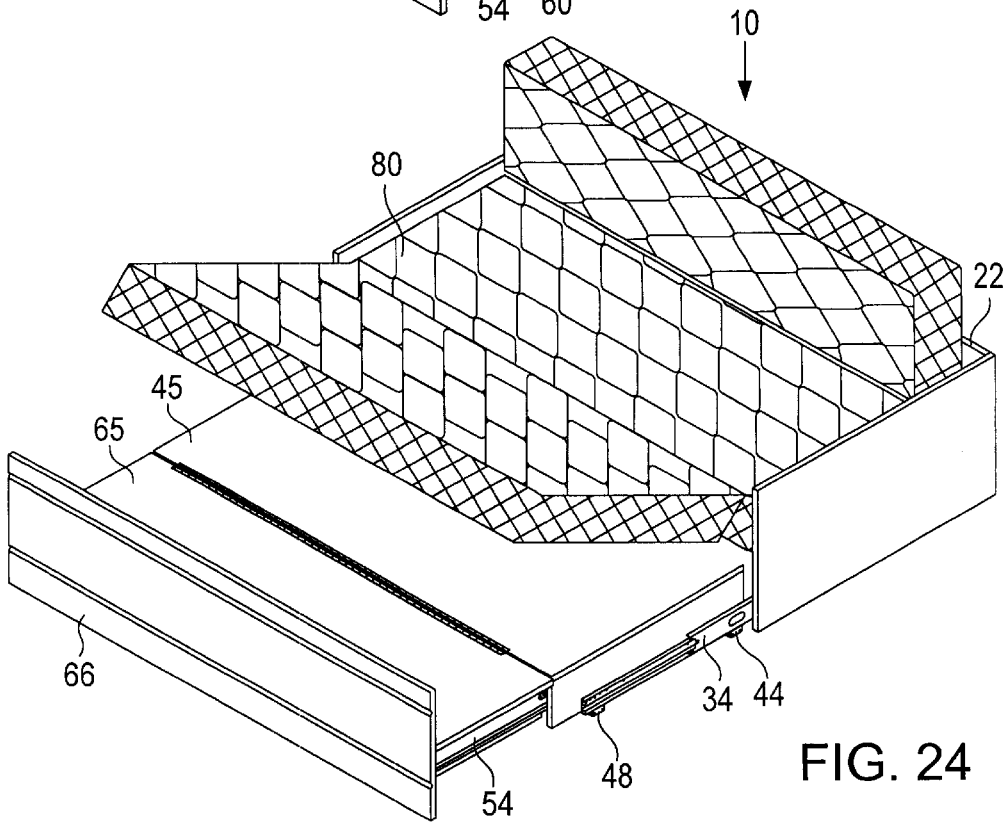
FIG. 24 illustrates a perspective view of the convertible wall bed/seat with mattress.
Figure 25:
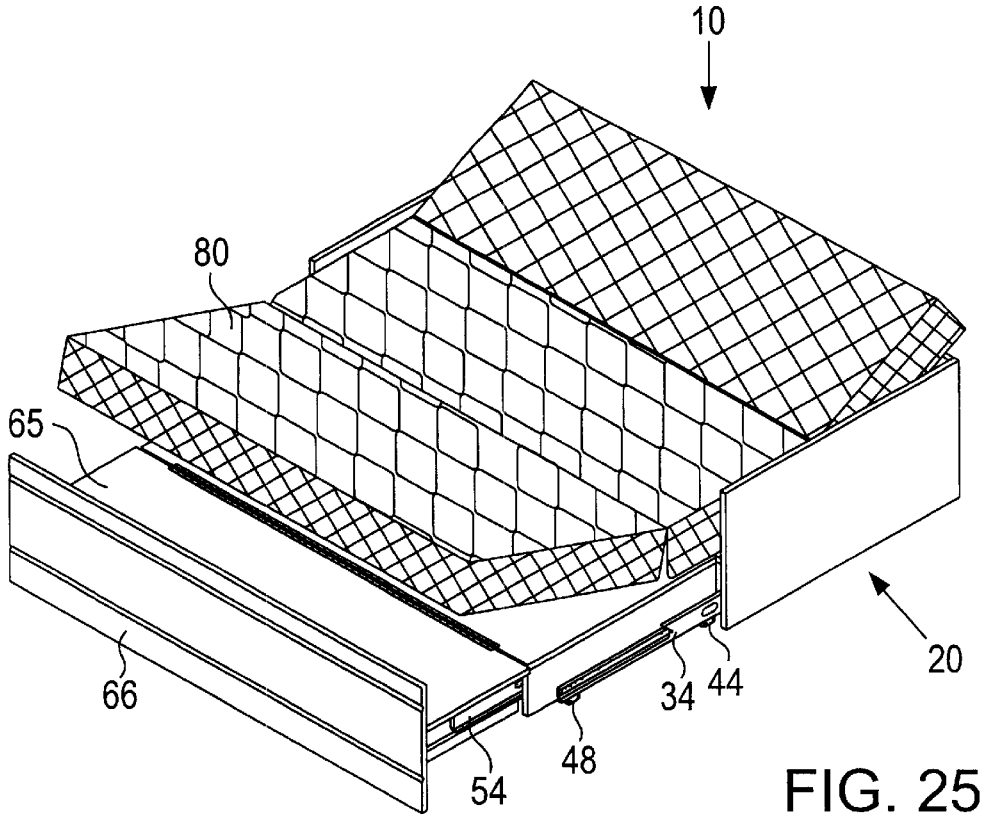
FIG. 25 illustrates a perspective view of the convertible wall bed/seat with mattress.
Figure 26:
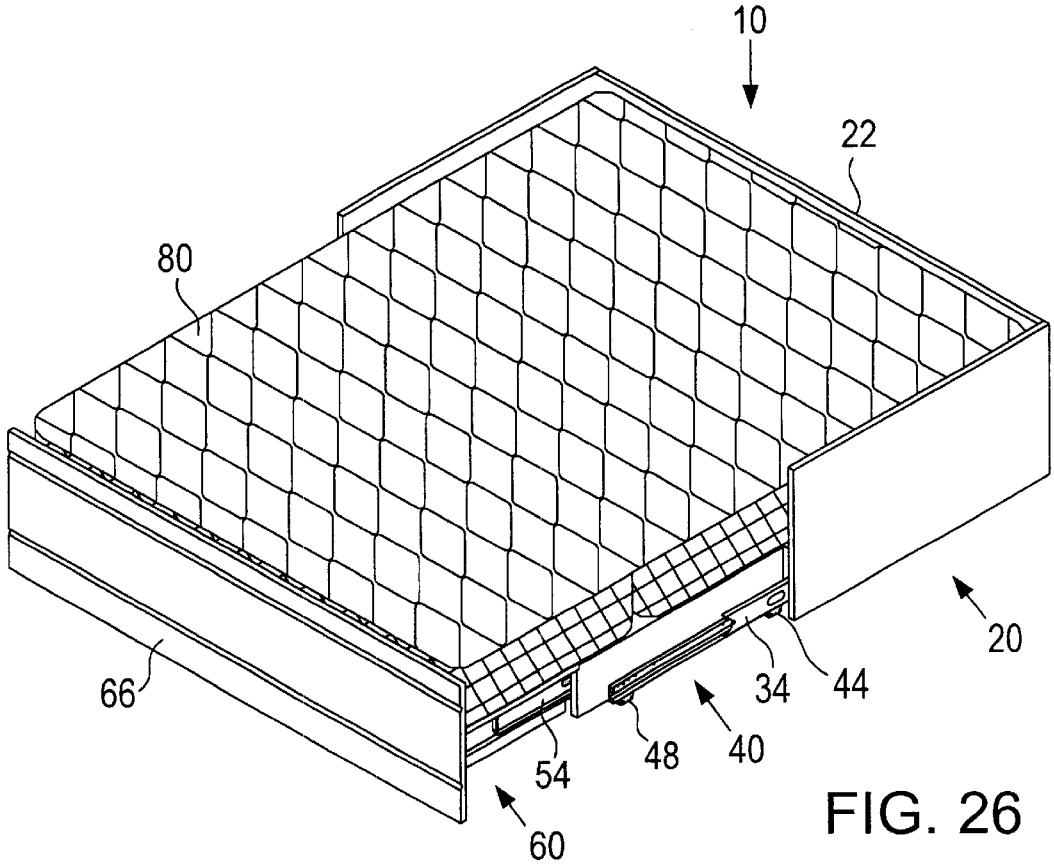
FIG. 26 illustrates a perspective view of the convertible wall bed/seat with mattress.
Figure 27:
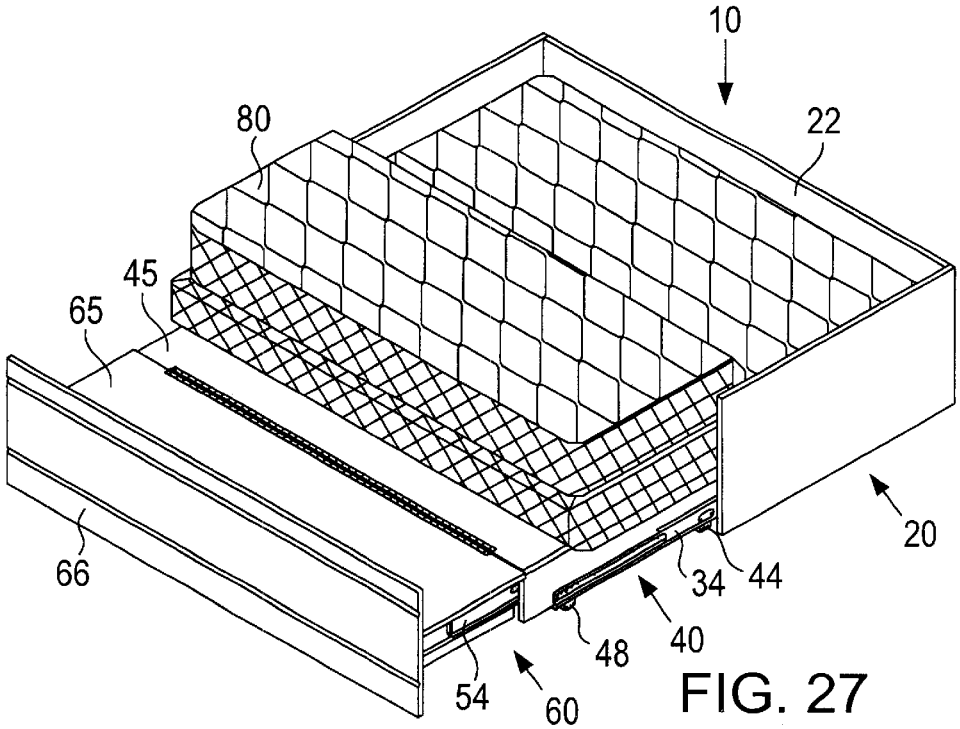
FIG. 27 illustrates a perspective view of the convertible wall bed/seat with mattress.
Figure 28:
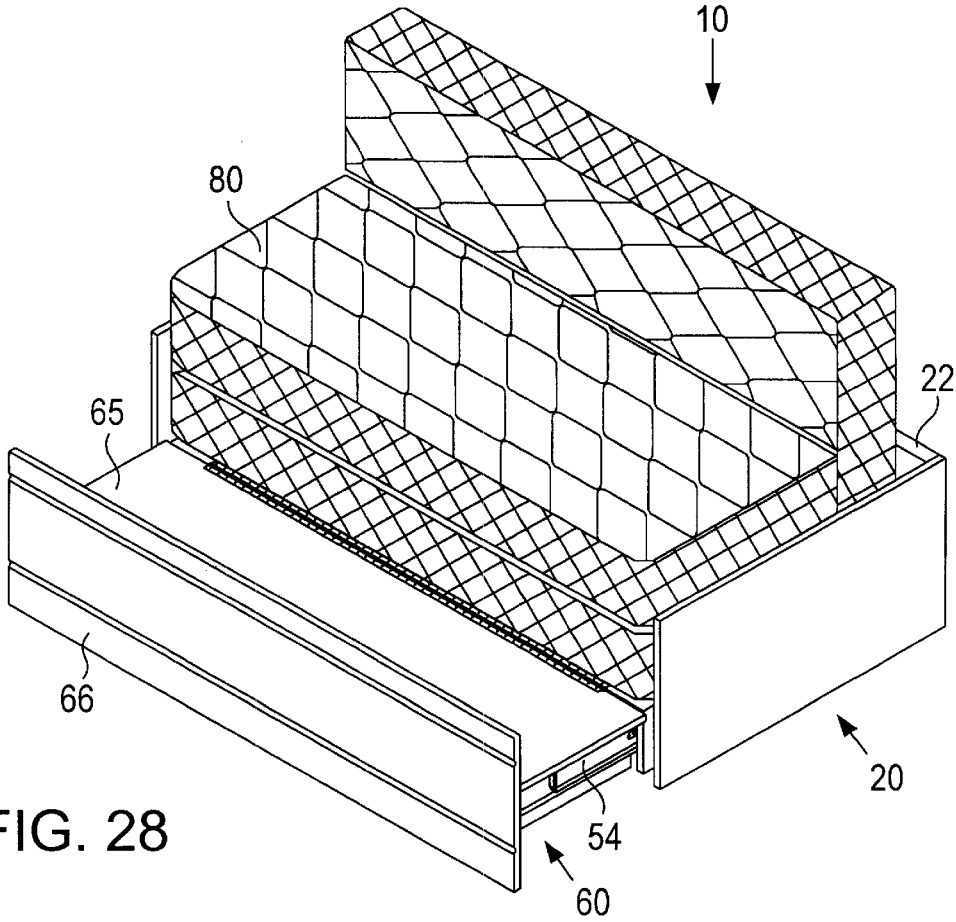
FIG. 28 illustrates a perspective view of the convertible wall bed/seat with mattress.
Figure 29:
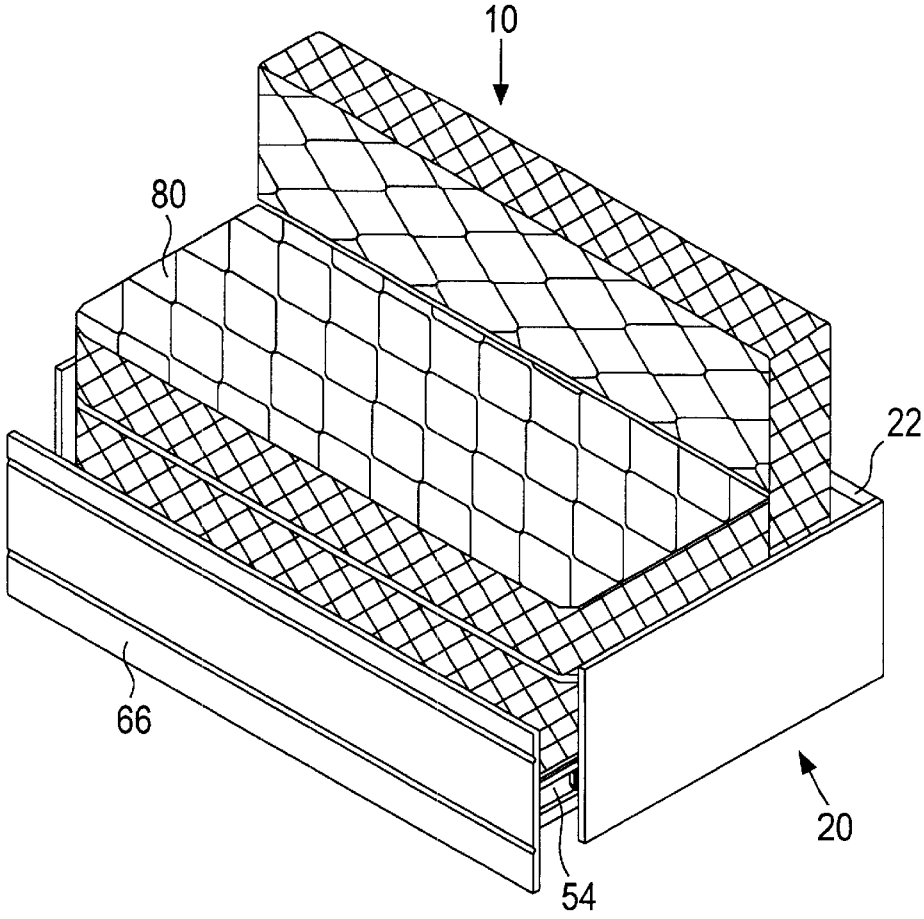
FIG. 29 illustrates a perspective view of the convertible wall bed/seat with mattress.
Figure 30:
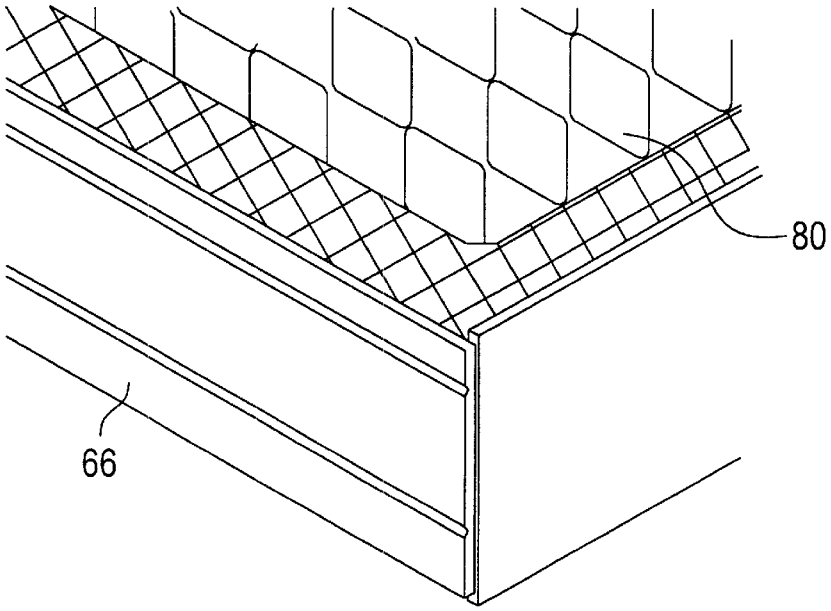
FIG. 30 illustrates a perspective view of the right side of the third section with mattress.
Figure 31:
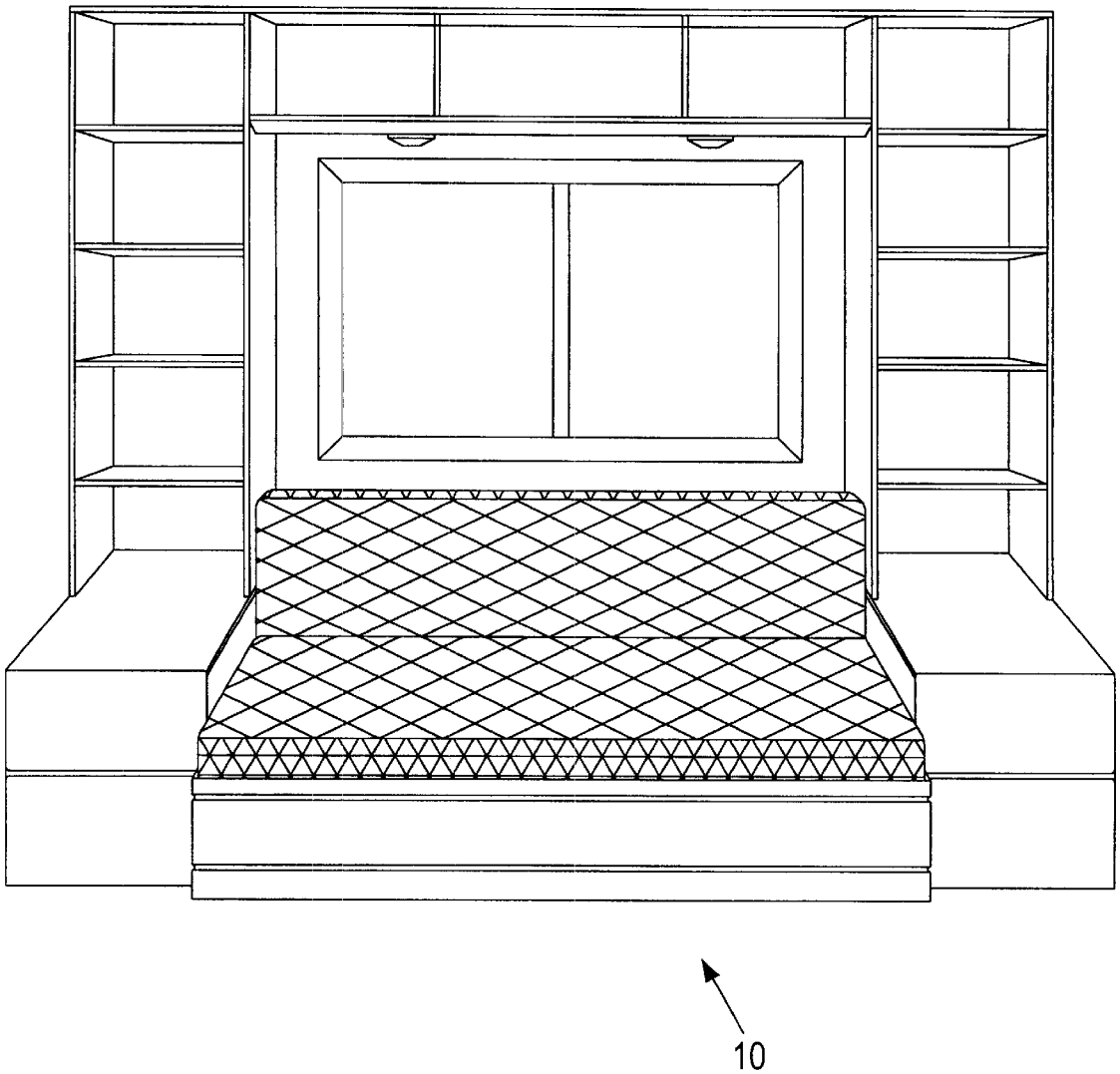
FIG. 31 illustrates a perspective view of the convertible wall bed/seat with mattress installed against a wall.

Referring to FIGS. 1 through 31, which illustrate a convertible wall bed/seat generally identified by reference number 10, in accordance with a first preferred embodiment of the present invention, convertible wall bed/seat 10 is generally comprised of first section 20, second section 40, and third drawer storage section 60.

First section 20 is preferably substantially rectangular in configuration and is positioned against, for example, a wall to form the head portion of a bed when convertible wall bed/seat 10 is in its bed configuration and the seat portion of a seat when convertible wall bed/seat 10 is in its seat configuration. The portion of the first section distal from the back 22 is preferably open to allow second section 40 to be slideably received therein. As seen in, for example, FIG. 15, second section 40 is preferably attached to first section 20 by, for example, locking casters 42 and 48 and drawer guides 32 and 34 to allow second section 40 to form the middle section of convertible wall bed/seat 10 when in its bed configuration or be stored in the interior of first section 20 when convertible wall bed/seat 10 is in its seat configuration.

The distal portion of second section 20 is preferably open to allow third drawer storage section 60 to be slideably received therein. As seen in, for example, FIG. 15, third drawer storage section 60 is preferably attached to second section 40 by, for example, drawer guides 52 and 54, and locking casters 62 and 64, to allow third drawer storage section 60 to form the foot section of convertible wall bed/seat 10 when in its bed configuration or to be stored in the interior of first section 20 when convertible wall bed/seat 10 is in its seat configuration. In addition, the top of third drawer storage section 60 is preferably open to allow items to be stored therein.

In a preferred embodiment of convertible wall bed/seat 10 shown in FIGS. 1 through 31, panel 25 is preferably moveable in a vertical direction in relation to first section 20. More preferably, panel 25 is attached to first section 20 by lid stays 26 and 28, which are friction actuated members which also have the capability to allow panel 25 to move in a downward direction. Thus, when convertible wall bed/seat 10 is in its seat configuration with second section 40 and third drawer storage section 60 within first section 20, lid stays 26 and 28 enable panel 25 to move to its downward position. Thus, panel 25 acts as a head portion, panel 45 acts as a middle portion, and panel 65 acts as a foot portion, when convertible wall bed/seat 10 is in its bed configuration. On the other hand, panel 25 acts as a seat surface and sections 40 and 60 are positioned within section 20 when convertible wall bed/seat 10 is in its seat configuration to accommodate its convertible wall bed/seat mattress 80 in its folded seat configuration.

In an embodiment of convertible wall bed/seat 10 shown in FIGS. 1 through 31, convertible wall bed/seat mattress 80, futons, and cushions may be placed on convertible wall bed/seat 10 when in its bed configuration and/or seat configuration. In addition, as seen in, for example, FIGS. 1 and 2, convertible wall bed/seat mattress 80 could be utilized as a mattress when convertible wall bed/seat 10 is in its bed configuration and as a seat cushion when convertible wall bed/seat 10 is in its seat configuration.

To convert convertible wall bed/seat 10 from its seat configuration to its bed configuration, drawer face 66 on third drawer storage section 60 is pulled outwardly away from first section 20 to slide third drawer storage section 60 outwardly from second section 40 along locking casters 62 and 64 and drawer guides 52 and 54. Second section 40 is pulled outwardly from first section 20 along locking casters 42 and 48, and drawer guides 32 and 34. When fully extended, lid stays 26 and 28 allow panel 25 to settle downwardly approximately 2 inches to obtain the same height as panels 45 and 65, forming a substantially flat surface. Convertible wall bed/seat mattress 80 is pulled forward over panels 45, and 65 to form a bed.

To convert convertible wall bed/seat 10 from its bed configuration to its seat configuration, convertible wall bed/seat mattress 80 is folded and placed on panel 25 to form a seat in the seat position. Panel 25 is manually raised. Drawer face 66 of third storage drawer section 60 is pushed inwardly toward the interior of second section 40 on drawer guides 52 and 54 and locking casters 42 and 48. Second section 40, now containing third section 60, is then pushed inwardly into the interior of first section 20 along drawer guides 32 and 34 and locking casters 42 and 48. The convertible wall bed/seat mattress 80 is now in its seat position, and additional pillows, seat cushions, covers and other items can be positioned on convertible wall bed/seat mattress 80 when in its seat configuration for decorative purposes and/or to enhance the comfort of the convertible wall bed/seat mattress 80.

Although the present invention has been described above in detail, the illustration is for example only and is not to be taken as a limitation on the present invention. For example, other arrangements for convertible wall bed/seat 10 with convertible wall bed /seat mattress 80 could be readily utilized in accordance with the teachings of the present invention. Accordingly, the scope and content of the present invention are to be defined only by the terms of the appended claims.

What is claimed is:

1. A convertible wall bed/seat movable between a seat configuration and a bed configuration, the convertible wall bed/seat comprising:

a first section comprising two side walls connected by a back side wall, a top cover, and an open front area;

a second section slideably receivable in the open front area of the first section when in the seat configuration, the second section comprising two side walls connected to a first top cover section, a second top cover section connected to the first top cover section, and an open front area; and a third section slideably receivable in the open front area of the second section when in the seat configuration, wherein the third section is a drawer having two sides, a back side, a front side, a bottom, and an open top area, wherein the drawer is extendable when the second section is in the seat configuration;

wherein the bed configuration is formed when the third section is extended from the second section and the second section is extended from the first section, wherein the second top cover of the second section is positioned to cover the open top area of the third section such that the first top cover of the second section is flush with the second top cover of the second section, and the cover of the first section is positionable such that the cover of the first section is flush with the first cover of the second section.

2. The convertible wall bed/seat of claim 1, wherein the first top cover of the second section is the same width as the second top cover of the second section.

3. The convertible wall bed/seat of claim 1, wherein the second section and the first section form separate covered storage areas when in the bed configuration.

4. The convertible wall bed/seat of claim 1, wherein the first top cover of the second section is connected to the second top cover of the second section by a piano style hinge.

5. The convertible wall bed/seat of claim 1, wherein the second section is slideably attached to the first section by drawer guides, and the third section is slideably attached to the second section by drawer guides.

6. The convertible wall bed/seat of claim 1 further comprising a one piece mattress positionable over the top covers of the convertible wall bed/seat when in the bed configuration.

7. The convertible wall bed/seat of claim 1, wherein the front side of the third section includes a drawer face on the outer surface thereof.

* * * * *